United States Patent [19]

Greve et al.

[11] 4,259,769

[45] Apr. 7, 1981

[54] METHOD AND APPARATUS FOR BANDING TOWS OF FILAMENTARY MATERIAL

[75] Inventors: Heinz Greve, Hamburg; Günter Wahle, Reinbek, both of Fed. Rep. of Germany

[73] Assignee: Hauni-Werke Körber & Co. KG, Hamburg, Fed. Rep. of Germany

[21] Appl. No.: 25,041

[22] Filed: Mar. 29, 1979

[30] Foreign Application Priority Data

Apr. 5, 1978 [DE] Fed. Rep. of Germany ..... 2814605

[51] Int. Cl.[3] ..... D02J 1/18

[52] U.S. Cl. ..... 28/283; 28/248

[58] Field of Search ..... 19/300; 28/248, 283

[56] References Cited

U.S. PATENT DOCUMENTS 3,345,697 10/1967 Aspy, Jr. .
3,412,856 11/1968 Esenwein .
3,971,695 7/1976 Block .

OTHER PUBLICATIONS

Stern, H. *Fluidics in Synthetic Fiber Quality Control*, Modern Textiles, 53(11): pp. 10–14, Nov., 1972.

*Primary Examiner*—Robert Mackey
*Attorney, Agent, or Firm*—Peter K. Kontler

[57] ABSTRACT

A running tow of filamentary filter material is banded by a plurality of streams of compressed air which issue from the orifices of plenum chambers forming a row which extends transversely of the direction of transport of the tow. The streams which issue from the plenum chambers band discrete strip-shaped portions of the tow. The density of such strip-shaped portions is monitored at or downstream of the banding station, and the pressure of air in one or more chambers is increased or reduced when the monitored density of the respective strip-shaped portion or portions deviates from a desired density. The monitoring devices can utilize optoelectronic or electropneumatic transducers.

10 Claims, 3 Drawing Figures

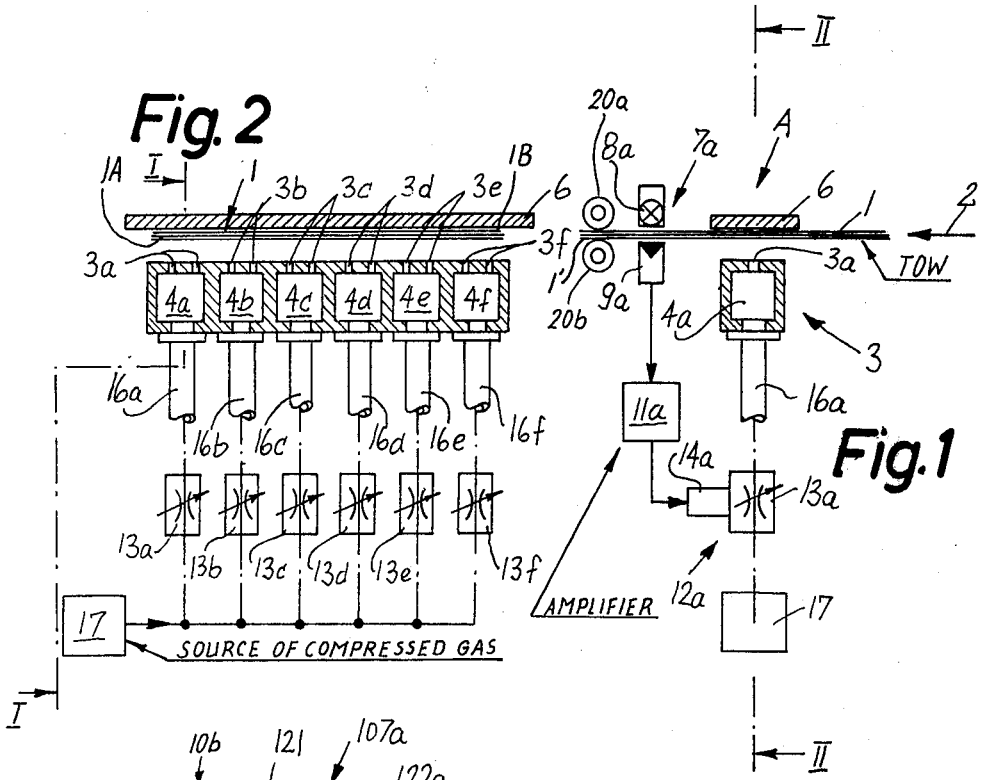
Fig. 2
Fig. 1
1A
I
1
3b
3c
3d
3e
1B
6
3f
3a
4a
4b
4c
4d
4e
4f
16a
16b
16c
16d
16e
16f
13a
13b
13c
13d
13e
13f
17
SOURCE OF COMPRESSED GAS
II
20a
8a
7a
A
6
1
2
TOW
1'
20b
9a
4a
3
11a
14a
12a
AMPLIFIER
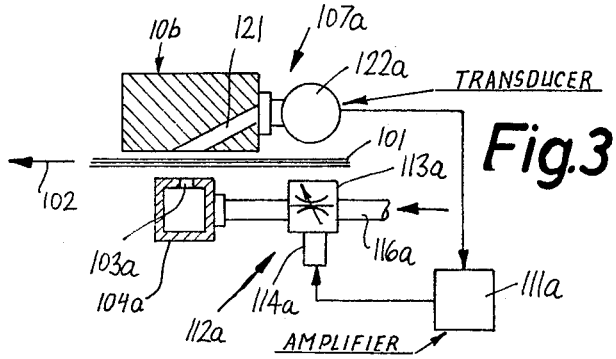
Fig.3
10b
121
107a
122a
TRANSDUCER
101
113a
102
103a
104a
116a
114a
112a
111a
AMPLIFIER

METHOD AND APPARATUS FOR BANDING TOWS OF FILAMENTARY MATERIAL

BACKGROUND OF THE INVENTION

The present invention relates to a method and apparatus for treating tows or ropes which consist of filamentary material. More particularly, the invention relates to improvements in banding of filamentary material which can be used as a filler in filter mouthpieces of cigarettes, cigars or cigarillos. Still more particularly, the invention relates to improvements in banding of a running tow or rope of filamentary material.

A tow of filamentary filter material (e.g., acetate fibers) must be treated in a filter rod making machine prior to conversion into the filler of a continuous filter rod. The filter rod is obtained by draping a web of wrapper material around the rod-like filler. Reference may be had to commonly owned U.S. Pat. No. 3,971,695 granted July 27, 1976 to Hans-Jürgen Block. This patent describes the conversion of a tow which is withdrawn from a bale into a rod-like filler. Such conversion involves spreading the tow to form a wide layer of substantially parallel filaments, spraying the layer with atomized plasticizer while the tow is stretched in the space between two pairs of rolls which rotate at different speeds, and causing the layer to pass through a so-called gathering horn which converts the layer into a rod. The plasticizer (e.g., triacetin) causes portions of neighboring filaments to adhere to each other so as to form a maze of intricate paths for the flow of tobacco smoke toward the smokers's mouth. In the next step, the continuous rod-like filler is draped into a web of cigarette paper, imitation cork or other suitable wrapping material, and the resulting continuous filter rod is subdivided into sections of desired length. For example, the filter rod can be subdivided into sections of six times unit length which are thereupon conveyed into the magazine of a filter tipping machine, e.g., a machine known as MAX manufactured by the assignee of the present application.

The conversion of a tow into a wide layer wherein the filaments are parallel or nearly parallel to each other can be effected by mechanical means. It is also known to resort to pneumatic banding devices, for example, to devices of the type disclosed in U.S. Pat. No. 3,345,697 granted Oct. 10, 1967 to Aspy. Two pneumatic banding devices are shown, at 21 and 24 in FIG. 1, in the aforementioned commonly owned U.S. Pat. No. 3,971,695 to Block. A drawback of presently known banding devices, including the pneumatic banding device of Aspy, is that they cannot convert a tow (whose width varies in random fashion) into a layer of constant or nearly constant width and that they cannot insure uniform distribution of filaments in the layer. Though the filaments of the tow are readily movable with respect to each other, presently known pneumatic banding devices are incapable of reliably converting the tow into a layer of uniform thickness, width and density because the accumulations of filaments in certain (thicker) strip-shaped portions of the running tow are not spread apart in the same way as the thinner strip-shaped portions of the tow. Streams of air which pass through the tow in a conventional pneumatic banding device flatten and increase the width of the tow; however, their equalizing or homogenizing action (as considered in a direction transversely of the direction of transport of the tow) is far from uniform. It must be borne in mind that the filaments of the tow which is withdrawn from a bale are crimped and are intimately interlaced with each other. The streams of air which are used in conventional banding devices are capable of widening and equalizing relatively thin portions but cannot achieve the same degree of equalizing action upon thicker strands of the tow. The patent to Aspy discloses a relatively wide box through which the tow advances and wherein a transversely extending wide nozzle discharges compressed air against one side of the tow. The stream of compressed air achieves a desirable widening of the tow and changes the orientation of filaments; however, its banding action is not entirely satisfactory, especially when the width of the tow varies within a wide range, i.e., when dense accumulations of filaments alternate with thinner portions which contain a lesser number of filaments.

OBJECTS AND SUMMARY OF THE INVENTION

An object of the invention is to provide a novel and improved method of banding a running foraminous tow of filamentary material in such a way that the width of the banded tow is more uniform and the orientation of filaments in the banded tow is more satisfactory than in tows which are treated in accordance with heretofore known techniques.

Another object of the invention is to provide a method which insures uniform banding of the entire running tow regardless of whether the tow is or is not of uniform width and regardless of eventual accumulations of larger quantities of filaments in certain longitudinally extending portions of the running tow.

A further object of the invention is to provide a novel and improved apparatus which can be utilized for the practice of the above outlined method.

An additional object of the invention is to provide an apparatus which can automatically break up and equalize larger accumulations of filamentary material in certain portions of the running tow.

Another object of the invention is to provide the apparatus with novel and improved means for regulating the banding action when the quality of the banded tow deviates from an optimum value.

One feature of the invention resides in the provision of a method of banding a foraminous tow of filamentary material wherein the filaments are movable with respect to each other. The method comprises the steps of transporting the tow lengthwise (e.g., from a bale into the nip of two advancing rolls) along an elongated path and in a predetermined direction, directing a plurality of discrete streams of pressurized gaseous fluid (e.g., air) transversely against the running tow so that each stream contacts and expands laterally a discrete strip-shaped portion of the tow (such strip-shaped portions extend lengthwise of the tow), monitoring the permeability of such strip-shaped portions of the running tow, and adjusting the expanding action of the respective streams (e.g., by increasing or reducing the quantity of pressurized fluid in one or more streams) when the monitored permeability (i.e., density) of the strip-shaped portions deviates from a predetermined optimum value.

In accordance with a presently preferred embodiment of the invention, the aforementioned strip-shaped portions of the running tow are adjacent to each other and they may, in their entirety, constitute the entire running tow.

The monitoring step may comprise directing a beam of radiation (e.g., light) across each strip-shaped portion of the running tow and generating signals denoting the intensity or another characteristic of that portion of each beam which penetrates through the respective strip-shaped portion. If the intensity of a beam portion is excessive or too low, the corresponding stream of pressurized fluid is adjusted accordingly. Alternatively, the monitoring step may include pneumatically measuring the permeability (density) of each strip-shaped portion, for example, by ascertaining the characteristics of those portions of fluid streams which penetrate through the corresponding strip-shaped portions of the running tow.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWINGS

FIG. 1 is a schematic longitudinal sectional view of a banding apparatus which embodies one form of the invention, the section being taken in the direction of arrows as seen from the line I—I of FIG. 2;

FIG. 2 is a transverse sectional view of the banding apparatus as seen in the direction of arrows from the line II—II of FIG. 1; and FIG. 3 is a longitudinal sectional view of a second banding apparatus.

DESCRIPTION OF THE PREFERRED EMBODIMENTS

FIGS. 1 and 2 show a rope or tow 1 which consists of filamentary filter material (e.g., acetate fibers) and is transported lengthwise in the direction of arrow 2. The means for transporting the tow 1 lengthwise includes a pair of driven advancing rolls 20*a*, 20*b* which draw the tow from a bale, not shown. The filaments of the tow 1 are normally crimped and are movable relative to each other. The width of the running tow 1 (i.e., the distance betwen the marginal portions 1A and 1B shown in FIG. 2) normally varies from increment to increment or at irregular intervals; therefore, and since the number of filaments in the tow is normally constant, the thickness and density of neighboring strip-shaped portions of the untreated tow vary from portion to portion or are higher in one or more portions but lower in other portions. The just discussed strip-shaped portions extend lengthwise of the tow 1, i.e., in substantial parallelism with the marginal portions 1A, 1B, and each such strip-shaped portion is caused to move past a discrete banding device 3 of the improved apparatus. In the embodiment of FIGS. 1 and 2, the apparatus comprises six neighboring banding devices 3 which respectively comprise plenum chambers 4*a*, 4*b*, 4*c*, 4*d*, 4*e*, 4*f* forming a file or row which extends transversely of the direction indicated by the arrow 2 and adjacent to a selected portion of the elongated path for the tow 1. The upper walls of the plenum chambers 4*a*–4*f* are adjacent to the underside of the running tow 1 and are respectively provided with pairs of orifices 3*a*, 3*b*, 3*c*, 3*d*, 3*e*, 3*f* which discharge streams of compressed gaseous fluid (preferably air) against the respective strip-shaped portions of the tow. The streams expand the respective strip-shaped portions laterally and equalize the distribution of filaments therein so that the tow 1 is converted into a wide layer 1′ wherein the orientation of filaments is substantially uniform and the density (permeability) of each laterally expanded strip-shaped portion matches or closely approaches a predetermined optimum value. Such mode of operation can be readily achieved if the density of the tow 1 which advances toward the banding station A (plenum chambers 4*a*–4*f*) is uniform all the way between the marginal portions 1A and 1B. However, the streams which issue from the orifices 3*a*–3*f* cannot effect an entirely uniform banding action if the density of one or more strip-shaped portions of the untreated tow 1 deviates from the density of the other strip-shaped portions.

In accordance with a feature of the invention, the apparatus comprises means for automatically regulating the pressure of fluid in various plenum chambers in dependency on density of the corresponding strip-shaped portions of the tow 1. This insures that the banding action of streams issuing from certain plenum chambers is more pronounced than the banding action of other streams with the result that the density of the layer 1′ is uniform regardless of the condition of successive increments of the tow 1 which advance toward the banding station A (i.e., toward that portion of the elongated path for the tow 1 which accommodates the plenum chambers 4*a*–4*f*). The streams of fluid which penetrate through the tow 1 at the station A impinge upon the underside of a stationary plate-like barrier 6 which is closely adjacent to the upper side of the running tow. It will be noted that the barrier 6 and the top walls of the plenum chambers 4*a*–4*f* define a relatively narrow clearance or channel wherein the filaments advance toward the nip of the advancing rolls 20*a*, 20*b*.

The means for automatically regulating the pressure of fluid in various plenum chambers in dependency on the density of corresponding strip-shaped portions of the tow 1 comprises discrete monitoring devices (one shown at 7*a* in FIG. 1) which measure the permeability (density) of strip-shaped portions of the layer 1′ immediately downstream of the banding station A and initiate the adjustment of fluid pressure in the corresponding chambers when the density of the adjacent strip-shaped portions of the layer 1′ deviates from a desired density. The monitoring device 7*a* is associated with the plenum chamber 4*a* and comprises a photocell including a light source 8*a* at one side and an optoelectronic transducer 9*a* at the other side of the corresponding strip-shaped portion of the layer 1′. The beam of radiation (light) which issues from the source 8*a* is directed against the upper side of the adjacent strip-shaped portion, and the electric signal at the output of the transducer 9*a* is indicative of the permeability (density) of the corresponding strip-shaped portion. If the intensity or another characteristic of the electric signal deviates from an optimum value (denoting the anticipated average density of a strip-shaped portion of the layer 1′), the pressure of fluid in the corresponding chamber 4*a* is adjusted accordingly, i.e., the pressure is increased or reduced. The signal from the output of the transducer 9*a* is transmitted to an amplifier 11*a* which transmits the amplified signal to a fluid pressure regulating or adjusting unit 12*a* including an adjustable flow restrictor 13*a* in a conduit 16*a* which connects a source 17 of compressed gaseous fluid with the inlet opening in the lower wall of the chamber 4*a*. The amplifier 11*a* is in circuit with a reversible electric DC-motor 14*a* which can change the rate of fluid flow through the adjustable flow restrictor 13*a* thus to adjust the banding action of fluid streams issuing from the orifices 3*a* of the chamber 4*a*. The illustrated regulating unit 12*a* constitutes but one form of means for varying the pressure of fluid in the chamber 4*a* in response to electric signals of varying intensity.

The regulating units for the chambers 4*b*–4*f* are identical with or analogous to the unit 12*a*. FIG. 2 merely shows the adjustable flow restrictors 13*b*–13*f* and the conduits 16*b*–16*f* of the other regulating units. The source 17 is common to all plenum chambers.

The operation of the banding apparatus of FIGS. 1 and 2 is as follows:

The tow 1 is drawn from the bale and advances between the plenum chambers 4*a*–4*f* and the barrier 6 on its way toward the nip of the advancing rolls 20*a*, 20*b*. If one of the monitoring devices (e.g., the monitoring device 7*a* which is associated with the plenum chamber 4*a*) detects that the density of the corresponding strip-shaped portion of the tow 1 is excessive or too low, the signal from the output of the transducer 9*a* is amplified at 11*a* and is transmitted to the adjusting unit 12*a* to respectively increase or reduce the rate of flow of compressed fluid from the source 17, through the flow restrictor 13*a* and thence into the plenum chamber 4*a*. Such adjustment of the rate of fluid flow from the chamber 4*a* is even more effective if the density of the neighboring strip-shaped portion (above the orifices 3*b*) is too low or too high because the pressure of fluid in the chamber 4*b* is then reduced or increased simultaneously with an increase or reduction of pressure in the chamber 4*a*, i.e., the fluid which issues from the orifices 3*a* can readily displace the filaments of the corresponding strip-shaped portion into the region of the adjacent strip-shaped portion above the chamber 4*b* or vice versa. It has been found that the improved apparatus invariably converts the tow 1 into a relatively wide layer which is more homogeneous than the layers which are obtained by passing a tow through a conventional pneumatic banding apparatus.

FIG. 3 shows a portion of a modified banding apparatus wherein the optoelectronic monitoring means (such as 7*a*) of the first apparatus are replaced by pneumatic monitoring means, one of which is shown at 107*a*. All such parts of the modified apparatus which are identical with or clearly analogus to corresponding parts of the first apparatus are denoted by similar reference characters plus 100. Thus, the tow is shown at 101, the direction of transport of the tow 101 is indicated by the arrow 102, the barrier is shown at 106, one of the plenum chambers at 104*a* and one of the orifices of the chamber 104*a* at 103*a*.

The stream of gaseous fluid which issues from the orifice 103*a* of FIG. 3 penetrates across the corresponding strip-shaped portion of the tow 101 and enters a channel 121*a* in the barrier 106 to be admitted into an electropneumatic transducer 122*a* forming part of the monitoring device 107*a*. The transducer 122*a* may be a diaphragm transducer of the type disclosed in commonly owned U.S. Pat. No. 3,412,856 granted Nov. 26, 1978 to Esenwein. The output of the transducer 122*a* transmits electric signals to an amplifier 111*a* which, in turn, transmits such signals to the servomotor 114*a* for the adjustable flow restrictor 113*a* which is installed in the conduit 116*a* between the source (not shown) of compressed gaseous fluid and the plenum chamber 104*a*. The elements 113*a*, 114*a* constitute component parts of the adjusting or regulating device 112*a*. The other pneumatic monitoring devices and adjusting devices of the apparatus of FIG. 3 are respectively similar to or identical with the devices 107*a* and 112*a*.

The improved banding apparatus is susceptible of many additional modifications. For example, the number of plenum chambers can be increased above or reduced to less than six. Also, each plenum chamber can be provided with a single orifice or with three or more orifices for compressed gaseous fluid. The flow restrictors can be replaced with suitable valves, and the streams of gaseous fluid can be sucked through the respective strip-shaped portions of the tow.

An important advantage of the improved banding apparatus is that the homogeneousness of the layer into which the tow 1 or 101 is converted is enhanced automatically and that the width of such layer is more uniform than that of layers which issue from conventional banding apparatus. Furthermore, the improved apparatus is simple, compact and inexpensive, and it can be readily installed in existing filter rod making machines as a superior substitute for heretofore known apparatus.

Without further analysis, the foregoing will so fully reve of the claims.

We claim:

1. A method of banding a foraminous tow of filamentary material wherein the filaments are movable relative to each other, comprising the steps of transporting the tow lengthwise along an elongated path; directing a plurality of discrete streams of a pressurized gaseous fluid transversely across the running tow so that each stream contacts and expands laterally a discrete strip-shaped portion of the tow; monitoring the permeability of said strip-shaped portions of the running tow; and adjusting the expanding action of the respective streams when the monitored permeability of said strip-shaped portions deviates from a predetermined value.

2. The method of claim 1, wherein said strip-shaped portions of the running tow are adjacent to each other.

3. The method of claim 1, wherein said monitoring step comprises directing beams of radiation across the respective strip-shaped portions of the running tow and generating signals denoting the intensity of those portions of said beams which penetrate through the respective strip-shaped, portions.

4. The method of claim 1, wherein said monitoring step comprises pneumatically measuring the permeability of said strip-shaped portions.

5. Apparatus for banding a foraminous tow of filamentary material wherein the filaments are movable relative to each other, comprising means for transporting the tow lengthwise along an elongated path; a plurality of adjustable banding devices each including means for directing at least one stream of a pressurized gaseous fluid transversely across the tow whereby the streams expand laterally the corresponding strip-shaped portions of the running tow; means for monitoring the density of said strip-shaped portions; and means for adjusting said banding devices when the density of the respective strip-shaped portions deviates from a predetermined value.

6. The apparatus of claim 5, wherein said banding devices are adjacent to each other, as considered transversely of the direction of transport of the tow, so that said strip-shaped portions of the tow are contiguous.

7. The apparatus of claim 5, wherein each of said monitoring means comprises optoelectronic transducer means.

8. The apparatus of claim 5, wherein each of said monitoring means comprises a pneumatic density measuring device.

9. The apparatus of claim 5, wherein said banding devices are adjacent to a first portion of said path and said monitoring means are adjacent to a second portion of said path.

10. The apparatus of claim 5, wherein each of said banding devices comprises a plenum chamber having a plurality of orifices for directing streams of compressed air against the respective strip-shaped portions of the running tow.

* * * * *